United States Patent [19]

Di Fonzo

[11] Patent Number: 4,467,731

[45] Date of Patent: Aug. 28, 1984

[54] STEAM INJECTION SYSTEM FOR AN INCINERATOR

[75] Inventor: Mark A. Di Fonzo, Brookfield, Wis.

[73] Assignee: Kelley Company, Inc., Milwaukee, Wis.

[21] Appl. No.: 407,954

[22] Filed: Aug. 13, 1982

[51] Int. Cl.[3] ..... F23G 5/00

[52] U.S. Cl. ..... 110/235; 110/244; 110/346; 110/307

[58] Field of Search ..... 110/150, 157, 243, 246, 110/254, 304, 306, 307, 308, 346, 348, 245, 235, 298, 244

[56] References Cited

U.S. PATENT DOCUMENTS

| | | | |
|---|---|---|---|
| 4,354,440 | 10/1982 | McRee, Jr. | 110/244 X |
| 4,372,226 | 2/1983 | Erlandsson | 110/235 X |
| 4,379,433 | 4/1983 | Hoskinson | 110/235 X |

FOREIGN PATENT DOCUMENTS

| | | | |
|---|---|---|---|
| 43567 | 1/1982 | European Pat. Off. | 110/307 |
| 42867 | 4/1979 | Japan | 110/346 |

OTHER PUBLICATIONS

"Controlled Air Incineration", Environmental Control Products, Inc.

*Primary Examiner*—Henry C. Yuen
*Attorney, Agent, or Firm*—Andrus, Sceales, Starke & Sawall

[57] ABSTRACT

A steam injection system for an incinerator. The incinerator includes a housing that defines a combustion chamber, and a plenum is mounted beneath the housing. Air for the combustion process is fed to the plenum and steam is separately introduced into the plenum. The air and steam are mixed and the mixture is introduced into the lower end of the combustion chamber through one or more inlet pipes. The steam acts to reduce high localized temperatures in the combustion chamber to minimize clinker formation, as well as maximizing the conversion of fixed carbon to carbon dioxide.

3 Claims, 2 Drawing Figures

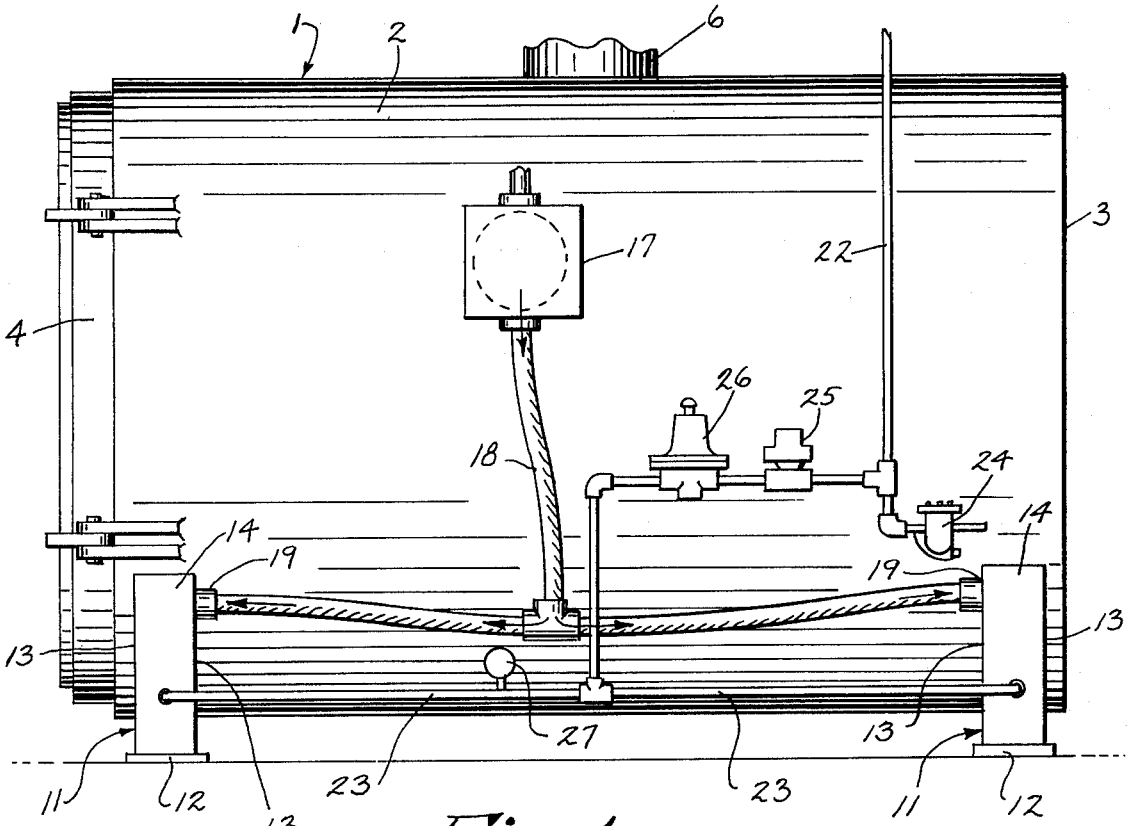
Fig. 1
Fig. 2
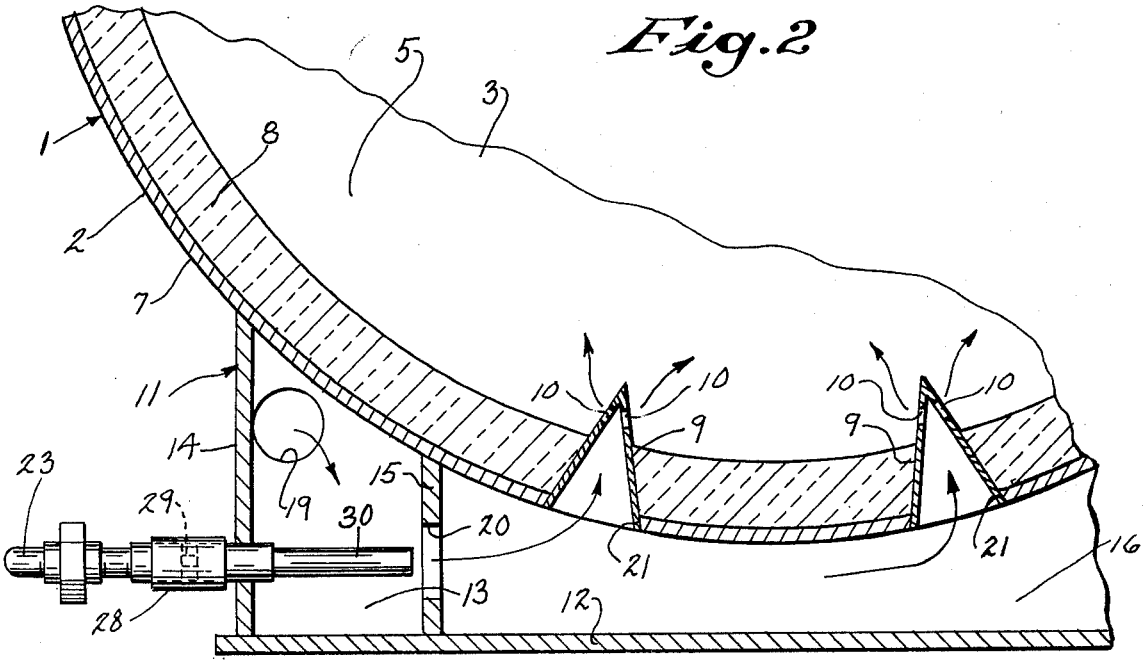

STEAM INJECTION SYSTEM FOR AN INCINERATOR

BACKGROUND OF THEINVENTION

In an incineration process it is desired to convert the residual or fixed carbon to carbon dioxide. The reaction of oxygen in air supplied to the combustion chamber with the carbon will result in the generation of carbon dioxide, but this reaction is exothermic, resulting in the release of heat from the reaction process. If this exothermic reaction is not controlled, the increased heat liberated through the reaction process can raise the temperature in the combustion chamber to a point where glass and metals may melt, resulting in the formation of clinkers. In order to reduce the high localized temperatures in the combustion chamber, it has been proposed in the past to introduce steam into the combustion chamber. The steam will react with the fixed carbon to form carbon monoxide and hydrogen, which is an endothermic reaction, absorbing heat from the combustion chamber and thereby reducing the high localized temperatures. The carbon monoxide and hydrogen formed in this reaction are subsequently burned in secondary zones of combustion to form carbon dioxide and water vapor.

By reducing the high localized temperatures in the combustion chamber by the introduction of steam, clinker formation is prevented, and the conversion of the fixed carbon to carbon dioxide is maximized.

In the past, steam has been injected into the combustion chamber through separate steam lines. In a typical incinerator having a steam injection system, the waste is moved longitudinally through the combustion chamber and air and steam are sequentially introduced at spaced locations along the length of the combustion chamber. This system does not produce a uniform reduction of temperature throughout the combustion chamber, but instead results in temperature fluctuations in which the temperature will rise as the waste passes over an air inlet tube and will subsequently be reduced as the waste approaches a steam entry tube. Furthermore, this conventional system requires the use of auxiliary steam lines, over and above the normal air supply lines, and during periods when steam is not being introduced the steam pipes can become overheated with possible damage.

SUMMARY OF THE INVENTION

The invention is directed to an improved steam injection system for an incinerator. The incinerator includes a closed housing that defines a combustion chamber and a pair of plenums are mounted at the lower end of the housing outside of the combustion chamber.

Air for the combustion process is fed to each plenum and steam is searately supplied to each plenum. The air and steam are mixed and the mixture is then introduced into the lower end of the combustion chamber through one or more perforated inlet tubes.

The introduction of steam with air will reduce high localized temperatures in the combustion chamber and prevent overheating and the formation of clinkers. In addition, the steam will aid in maximizing the conversion of the fixed carbon content to carbon dioxide which aids in the efficiency of the combustion operation.

The steam is injected into the combustion chamber in the area of highest temperature, i.e. the region where the air is introduced, and through the continual introduction of steam, the temperature is maintained at all times beneath levels which could cause clinker formation. Thus, an overall lesser volume of steam is required to maintain efficiency of the combustion process.

In addition, the system of the invention injects the steam through the existing air supply lines so that no auxiliary steam lines are required.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of an incinerator having the steam injection system of the invention; and FIG. 2 is an enlarged fragmentary vertical section showing the construction of the plenum.

DESCRIPTION OF THE ILLUSTRATED EMBODIMENT

FIG. 1 illustrates an incinerator 1 used for burning waste material and composed of a generally cylindrical body 2 having one end closed by a head 3. The opposite end of body 2 defines a feed or charging opening which is enclosed by a hinged door 4.

Body 2 defines a combustion chamber 5 wherein the waste material is burned and the waste gases of combustion are discharged from the combustion chamber through a stack 6 in the conventional manner.

The body 2, head 3. and door 4 of the incinerator are formed of a steel outer layer 7 having a refractory liner 8, as best shown in FIG. 2.

To supply air to the combustion chamber, a pair of generally V-shaped air tubes 9 are disposed in the lower end of the combustion chamber and extend the length of the chamber. Each air tube 9 is provided with a plurality of outlet ports 10 which are spaced along the length of the tube. Air being introduced into the tubes 9 will be discharged through ports 10 into the lower end of the combustion chamber.

In accordance with the invention, a pair of plenums 11 are disposed beneath the ends of the incinerator 1. Each plenum 11 includes a bottom surface 12 which rests on the foundation or other supporting structure, a pair of side walls 13 and a pair of end walls 14 which are connected to the outer end of the end walls. In addition, internal walls 15 connect the bottom plate 12 with the metal shell 7 of the incinerator and provide further support for the incinerator. Each plenum 11 in combination with the shell 7 of the incinerator defines a plenum chamber 16.

Blower unit 17 is mounted on the outside of the incinerator and is adapted to supply air for the combustion process. In this regard, the outlet of blower unit 17 is connected to line 18 and line 18 is branched and communicates with an inlet opening 19 in the respective plenums 11. With this construction, air from blower unit 17 will be supplied through line 18 to the plenum chambers 16.

As best shown in FIG. 2, the internal walls 15 are provided with openings 20 and similarly, the shell 7 is provided with openings 21 which provide communication between plenum chamber 16 and the air tubes 9. Thus, air entering the plenum chambers 16 through inlets 19 will pass through opening 20 and openings 21 into air tubes 9 and will be discharged through ports 10 into the combustion chamber.

In accordance with the invention, steam is separately supplied to each plenum chamber 16. A steam line 22 is connected to a suitable source of steam and line 22 is connected to branch lines 23, each of which communicates with the respective plenum chambers 16. A conventional condensate trap 24 can be connected in line 22 and a valve 25 and pressure regulator 26 are also connected in steam line 22. Pressure gauge 27 can be mounted in one of the branch lines 23 to provide a visual indication of the steam pressure.

As shown in FIG. 2, an orifice union 28 having an orifice 29 of reduced diameter, connects each branch line 23 to an outlet tube 30 which is located within the respective plenum 11. The steam passing through the orifice 29 will expand to thereby reduce the velocity of the steam and provide better mixing with the air in the plenum chamber 16.

The outlet tubes 30 face generally toward the metal shell 7 of the incinerator and as the shell is relatively hot, the contact of the steam with the shell will prevent condensation of the steam within the plenum chamber.

The mixture of steam and air is distributed through openings 21 to air tubes 9 and is discharged into the lower end of the combustion chamber. The region where the air is introduced into the combustion chamber is at the highest temperature, and thus the introduction of steam at this location will more effectively reduce high localized temperatures and maximize the conversion of fixed carbon to carbon dioxide.

In practice, the steam is normally introduced into the combustion chamber after a period of operation, perhaps two hours after start-up, and the steam is then injected continuously throughout the combustion process. By continuously adding steam along with air, the temperature in the combustion chamber will be reduced to a level where clinker formation will not be a problem.

The system of the invention utilizes the normal air supply tubes 9 and it is not necessary to incorporate additional inlet tubes for the supply of steam.

Various modes of carrying out the invention are contemplated as being within the scope of the following claims particularly pointing out and distinctly claiming the subject matter which is regarded as the invention.

I claim:

1. A steam injection system for an incinerator, comprising an incinerator defining a combustion chamber and having air inlet means disposed at the lower end of the combustion chamber, a plenum disposed outside of said incinerator adjacent the lower end thereof and defining a plenum chamber, said plenum chamber being in communication with said air inlet means, air supply means for introducing air into said plenum chamber, a steam supply line connected to a source of steam under pressure, outlet tube means connected to said steam supply and terminating in said plenum chamber for directing steam into contact with the outer surface of said incinerator, said steam being mixed with air in said plenum chamber and the mixture being fed through said air inlet means to the combustion chamber to thereby reduce high localized temperatures in said combustion chamber, and including an orifice disposed upstream from the discharge end of said outlet tube means, said orifice having a smaller cross-sectional area than said discharge end to thereby reduce the velocity of the steam entering said plenum chamber.

2. A steam injection system for an incinerator, comprising an incinerator defining a combustion chamber and having air inlet means disposed at the lower end of the combustion chamber, a plenum disposed outside of said incinerator adjacent the lower end thereof and defining a plenum chamber, said plenum extending circumferentially beneath the incinerator and serves to support the incinerator, said plenum including a pair of spaced side walls, a bottom wall connected to the lower edges of the side walls, and a pair of end walls connecting the outer ends of said side walls, said plenum in combination with the outer surface of said incinerator defining said plenum chamber, said plenum chamber being in communication with said air inlet means, air supply means for introducing air into said plenum chamber, a steam supply line connected to a source of steam under pressure, outlet tube means connected to said steam supply line and terminating in said plenum chamber for directing steam into contact with the outer surface of said incinerator, said steam being mixed with air in said plenum chamber and the mixture being fed through said air inlet means to the combustion chamber to thereby reduce high localized temperatures in said combustion chamber.

3. A steam injection system for an incinerator, comprising an incinerator defining a combustion chamber and having air inlet means including a tube extending along the bottom of the combustion chamber and having a series of outlet ports, a pair of plenums disposed outside of said incinerator adjacent the lower end thereof each of which defines a plenum chamber, one of said plenum chambers being in communication with one end of said air inlet means and the other of said plenum chambers being in communication with the other end of said air inlet means, air supply means for introducing air into said plenum chambers, a steam supply line connected to a source of steam under pressure, outlet tube means connected to said steam supply line and terminating in said plenum chambers for directing steam into contact with the outer surface of said incinerator, said steam being mixed with air in said plenum chambers and the mixture being fed through said air inlet means to the combustion chamber to thereby reduce high localized temperatures in said combustion chamber.

* * * * *

UNITED STATES PATENT AND TRADEMARK OFFICE

CERTIFICATE OF CORRECTION

PATENT NO. : 4,467,731

DATED : Auguat 28, 1984

INVENTOR(S) : MARK A. DiFONZO

It is certified that error appears in the above-identified patent and that said Letters Patent is hereby corrected as shown below:

Col. 4, Line 1, CLAIM 1, After "supply" insert ---line---

Signed and Sealed this

*Thirtieth* Day of *April 1985*

[SEAL]

*Attest:*

DONALD J. QUIGG

*Attesting Officer* *Acting Commissioner of Patents and Trademarks*